US006658997B2

(12) United States Patent
Matsumoto

(10) Patent No.: US 6,658,997 B2
(45) Date of Patent: Dec. 9, 2003

(54) APPARATUS FOR PRODUCING WASTE COMPRESSED SOLID

(75) Inventor: Takashi Matsumoto, Tokyo (JP)

(73) Assignee: Nicotec Co., Ltd., Tokyo (JP)

( * ) Notice: Subject to any disclaimer, the term of this patent is extended or adjusted under 35 U.S.C. 154(b) by 0 days.

(21) Appl. No.: 09/990,280

(22) Filed: Nov. 23, 2001

(65) Prior Publication Data

US 2002/0062745 A1 May 30, 2002

(30) Foreign Application Priority Data

Nov. 28, 2000 (JP) ..... P2000-361095
Jun. 11, 2001 (JP) ..... P2001-175780

(51) Int. Cl.[7] ..... B30B 15/30; B30B 7/00
(52) U.S. Cl. ..... 100/45; 100/138; 100/215
(58) Field of Search ..... 100/215, 45, 144, 100/145, 137, 138, 139

(56) References Cited

U.S. PATENT DOCUMENTS 4,074,803 A * 2/1978 Kollberg ..... 100/145
4,780,931 A * 11/1988 Powers et al. ..... 425/556
4,837,112 A * 6/1989 Calandro et al. ..... 426/450
4,947,743 A * 8/1990 Brown et al. ..... 100/127
5,322,009 A * 6/1994 Retrum ..... 100/139
5,524,534 A * 6/1996 Dietel ..... 100/209
5,611,268 A * 3/1997 Hamilton ..... 100/147
6,186,060 B1 * 2/2001 Peterson ..... 100/138

FOREIGN PATENT DOCUMENTS

JP 09-168897 A * 6/1997 ..... B30B/9/32
JP 09-239593 9/1997

OTHER PUBLICATIONS

Translation of JP 09–239593, Kimura Koji, "Waste compressed Solidifying Equipment", Sep. 1997.*

* cited by examiner

*Primary Examiner*—Allen Ostrager
*Assistant Examiner*—Jimmy T Nguyen
(74) *Attorney, Agent, or Firm*—Nath & Associates PLLC; Marvin C. Berkowitz

(57) ABSTRACT

An apparatus for producing a waste compressed solid according to the invention is provided with a hopper having an opening for receiving a waste in an upper side thereof and a discharge port in a bottom side, a feed screw conveyor for transferring the waste in the hopper to the discharge port, and a compression chamber connected to the discharge port of the hopper and having a compressing means. A shaft of the feed screw conveyor is formed in a taper shape so as to become gradually narrow toward a side of the discharge port of the hopper. Further, draw screw conveyors are provided with the hopper in a symmetrical manner so as to cross to the feed screw conveyor. A waste such as a metal chip or the like supplied to the hopper is drawn to a side of the feed screw conveyor by the draw screw conveyor, is fed to the compression chamber by the feed screw conveyor and is compressed by a piston. The waste compressed solid is continuously produced by continuously repeating the operation.

7 Claims, 8 Drawing Sheets

APPARATUS FOR PRODUCING WASTE COMPRESSED SOLID

BACKGROUND OF THE INVENTION

1. Field of the Invention

The present invention relates to an apparatus for producing a waste compressed solid.

2. Description of the Related Art

As an apparatus for compressing and solidifying a waste such as a metal chip or the like, a structure disclosed in Japanese Patent Application Laid-Open No. 9-239593 is known.

The waste compressing and solidifying apparatus mentioned above is based on a main body frame, and comprises a hopper capable of receiving a waste in the main body frame. A large-scaled supply opening portion is provided in an upper side of the hopper, and a discharge port is provided in a bottom side of the hopper. Further, a compression box provided with a compression chamber capable of being communicated with the discharge port, and a compressing means for compressing and solidifying the waste fed the compression chamber under a sealed state are provided in the main body frame. In order to feed the waste from the hopper to the compression chamber, a feed screw conveyor is provided inside the hopper so as to be capable of rotating, and the feed screw conveyor is structured such as to extend to a portion near the compression chamber.

The waste supplied into the hopper is fed to the discharge port of the hopper due to a rotation of the feed screw conveyor, and is transferred to the compression chamber. Further, the waste is made into the compressed solid in the sealed state due to an operation of the compressing means.

SUMMARY OF THE INVENTION

A filament-like waste such as the metal chip often coils around a screw shaft due to the rotation of the feed screw conveyor. In this state, when the feed screw conveyor further rotates, a lump of the coiling waste gradually grows so as to stay near the discharge port and it is necessary to interrupt the operation.

The present invention provides an apparatus for continuously producing a waste compressed solid without the waste staying in a hopper.

An apparatus for producing a waste compressed solid according to a first aspect of the present invention comprises a hopper comprising an opening for receiving a waste in an upper side thereof and a discharge port in a bottom side, a feed screw conveyor for transferring the waste to the hopper to the discharge port, and a compression chamber connected to the discharge port of the hopper and comprising a compressing means. The waste received by the hopper is carried to a side of the discharge port of the hopper by the feed screw conveyor, and is fed to the compression chamber. Next, the waste in the compression chamber is compressed and solidified by moving a piston. Accordingly, it is possible to produce a waste compressed solid from the waste. A shaft of the feed screw conveyor is formed in a taper shape so as to become gradually narrow from a base end side toward a front-end side. Accordingly, when the lump of the waste is fed to the feed screw conveyor, a twist of the waste with the shaft is gradually loosened and the waste is easily removed by itself.

According to a second aspect of the present invention, the apparatus for producing the waste compressed solid as mentioned above further comprises a control means for controlling a driving direction of the feed screw conveyer so that the feed screw conveyor can be alternately driven in both directions comprising a forward direction and a backward direction. Since the lump of the waste coiling around the feed screw conveyor is removed by alternately driving the screw conveyor in the forward direction and the backward direction, it is possible to continuously compress and solidify the waste without interrupting the operation.

According to a third aspect of the present invention, the apparatus for producing the waste compressed solid as mentioned above further comprises draw screw conveyors comprising a pair of spiral-shaped draw blades in the hopper so as to cross to the feed screw conveyor and be symmetrical with respect to the feed screw conveyor, wherein the draw blades draw the waste to the hopper in a direction of the feed screw conveyor. The draw blades of the draw screw conveyors are formed in a spiral shape wound around in both sides of the feed screw conveyor, wherein directions of the respective draw blades are directed opposite to each other, and can draw the waste to the side of the discharge port from both sides when rotated. A draw motor control unit is controlled so as to stop the draw screw conveyors or reverse rotate the draw screw conveyors at a time of rotating the feed screw conveyor in an opposite direction. Accordingly, it is possible to prevent the waste from clogging near the discharge port and it is possible to continuously compress and solidify the waste.

According to a fourth aspect of the present invention, the apparatus for producing the waste compressed solid as mentioned above further comprises first and second screw conveyors comprising spiral-shaped draw blades substantially vertical to the feed screw conveyor and substantially in symmetrical therewith, and first and second draw motors driving them respectively. It is possible to draw the waste to the side of the discharge port from both sides by driving a pair of draw screw conveyors by the respective draw motors. Further, according to this structure, since the shafts of the respective draw screw conveyors do not hang over the shaft of the feed screw conveyor, it is possible to prevent the lump of the waste coiling around the shaft of the feed screw conveyor from being caught on the respective draw screw conveyors. Further, the respective motor control units are controlled so that rotational speeds of the first and second draw screw conveyors are different from each other. A compelling force in a twisting direction is applied to the drawn waste by applying a difference to the rotational speeds of the draw screw conveyors, whereby it is possible to prevent the waste from floating up.

According to a fifth aspect of the present invention, the structure of the apparatus for producing the waste compressed solid is made as mentioned above, and further, a feed blade of the feed screw conveyor has substantially no length in a base portion of the feed screw conveyor and become gradually longer toward a direction of an end portion. Even when the waste received by the hopper is fine and much, it is hard that the waste is caught on the feed blade.

According to a sixth aspect of the present invention, the structure of the apparatus for producing the waste compressed solid is made as mentioned above, and further, a pitch of the feed blade in the feed screw conveyor becomes gradually narrower toward the side of the discharge port of the hopper, and gradually wider toward the side of the discharge port near the discharge port of the hopper. According to this structure, it is possible to slow the feed speed of the waste in the side of the discharge port rather than the side of the base end of the feed screw conveyor, and it is possible to make it faster near the discharge port. According to this structure, it becomes hard that the lump of the waste is caught on near the discharge port, and it is possible to continuously operate the apparatus for producing the waste compressed solid.

DETAILED DESCRIPTION OF THE PREFERRED EMBODIMENT

Figure 2:
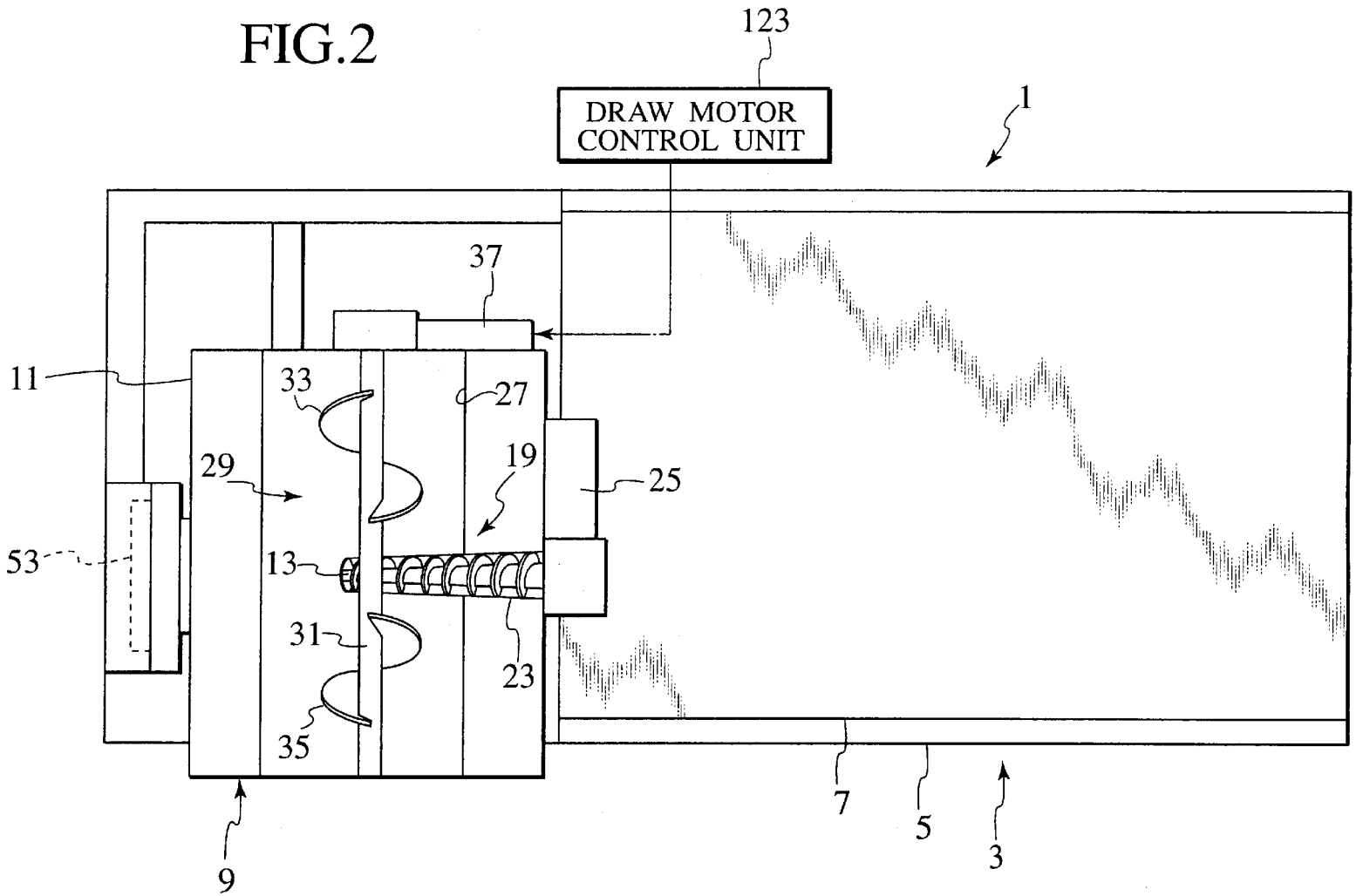
FIG. 2 is a plan view showing the apparatus for producing the waste compressed solid according to the first embodiment of the present invention.
Figure 3:
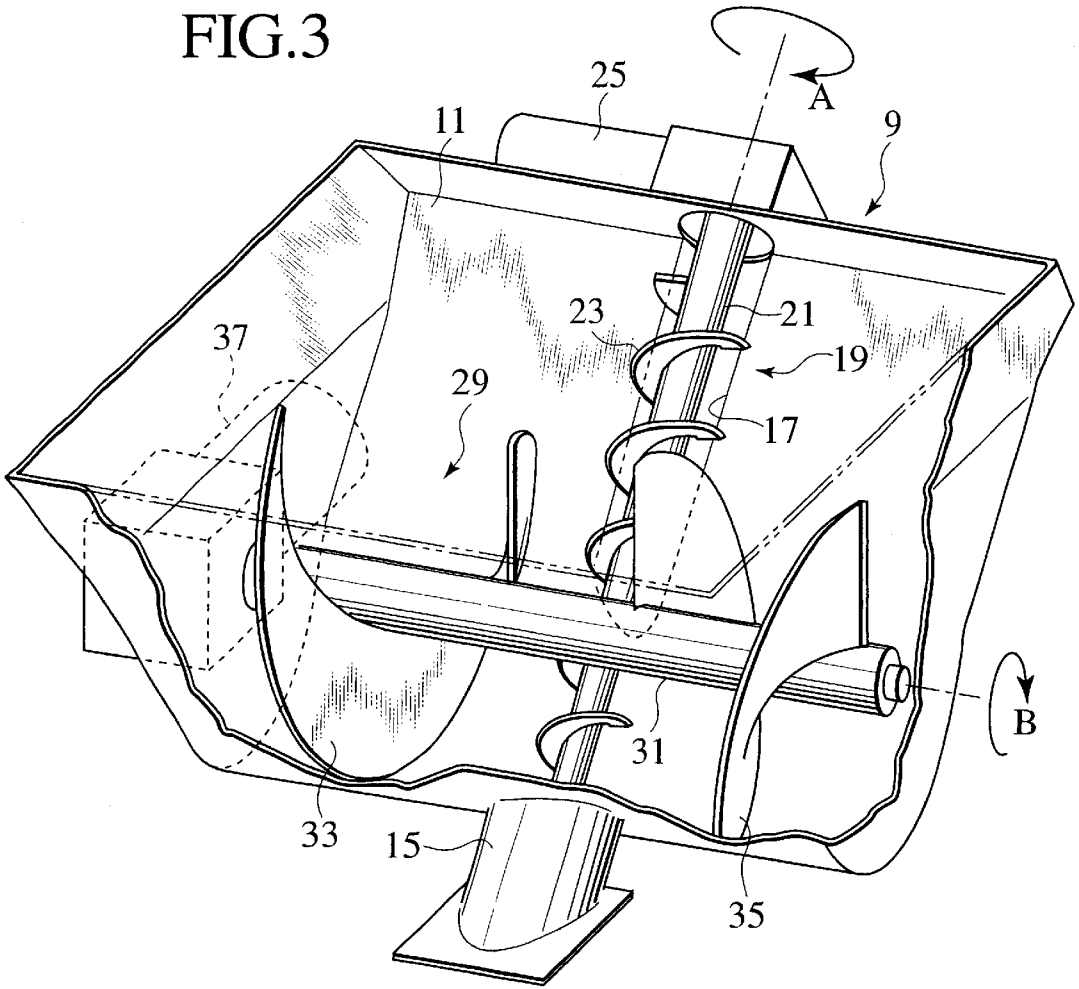
FIG. 3 is a perspective view showing an inner portion of a hopper in the apparatus for producing the waste compressed solid according to the first embodiment of the present invention.

A description will be given below of a structure of an apparatus for producing a waste compressed solid according to a first embodiment of the present invention with reference to FIGS. 1 to 3.

A waste compressed solid producing apparatus 1 according to the first embodiment of the present invention corresponds to an apparatus for producing a waste compressed solid by solidifying the waste such as a metal chip or the like, and is based on a main body frame 3. The main body frame 3 comprises a supporting frame 5 extending in a lateral direction in FIGS. 1 and 2, and a box-like frame 7 standing on a right side portion of the supporting frame 5.

A hopper 9 receiving a waste is provided in a left side of the box-like frame 7, and in order to collect the waste in a bottom portion of the hopper 9, the hopper 9 is formed in a V-shaped cross sectional shape. An opening 11 is provided in an upper side in FIG. 1 of the hopper 9, and a discharge port 13 is provided in a lower side of the hopper 9. One end of a connection pipe 15 is integrally provided in the discharge port 13 in the hopper 9 so as to be communicated therewith.

An inclined feed groove 17 is formed in an inner side of the hopper 9, and a feed screw conveyor 19 feeding the waste in the hopper 9 to the discharge port 13 is provided in the hopper 9. The feed screw conveyor 19 is provided with a rotatable feed screw shaft 21 disposed in the feed groove 17, a feed blade 23 integrally formed in a spiral manner so as to wind around the feed screw shaft 21, a feed motor 25 disposed at a suitable position in a right portion of the hopper 9 and connected to the feed screw shaft 21 in an interlocking manner, and a switching means 111 for alternately switching a rotational direction of the feed motor.

Figure 7:
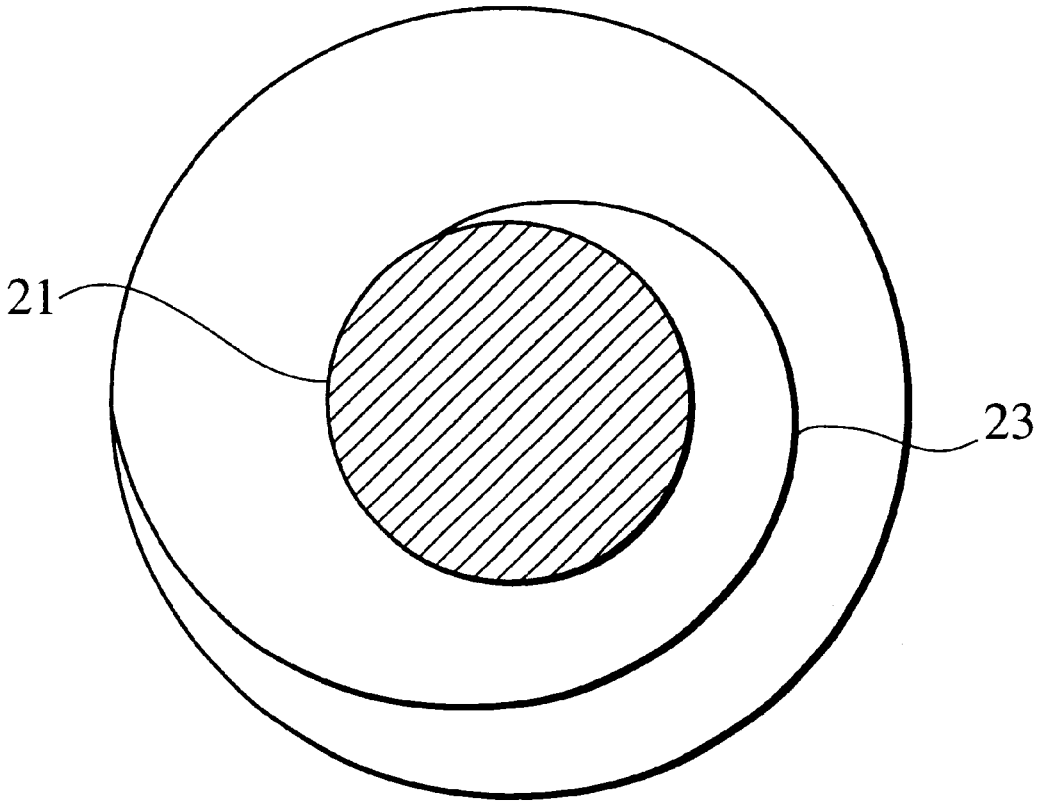
FIG. 7 is a view of the feed screw conveyor according to the present invention as seen along a line V—V in FIG. 6.
Figure 8:
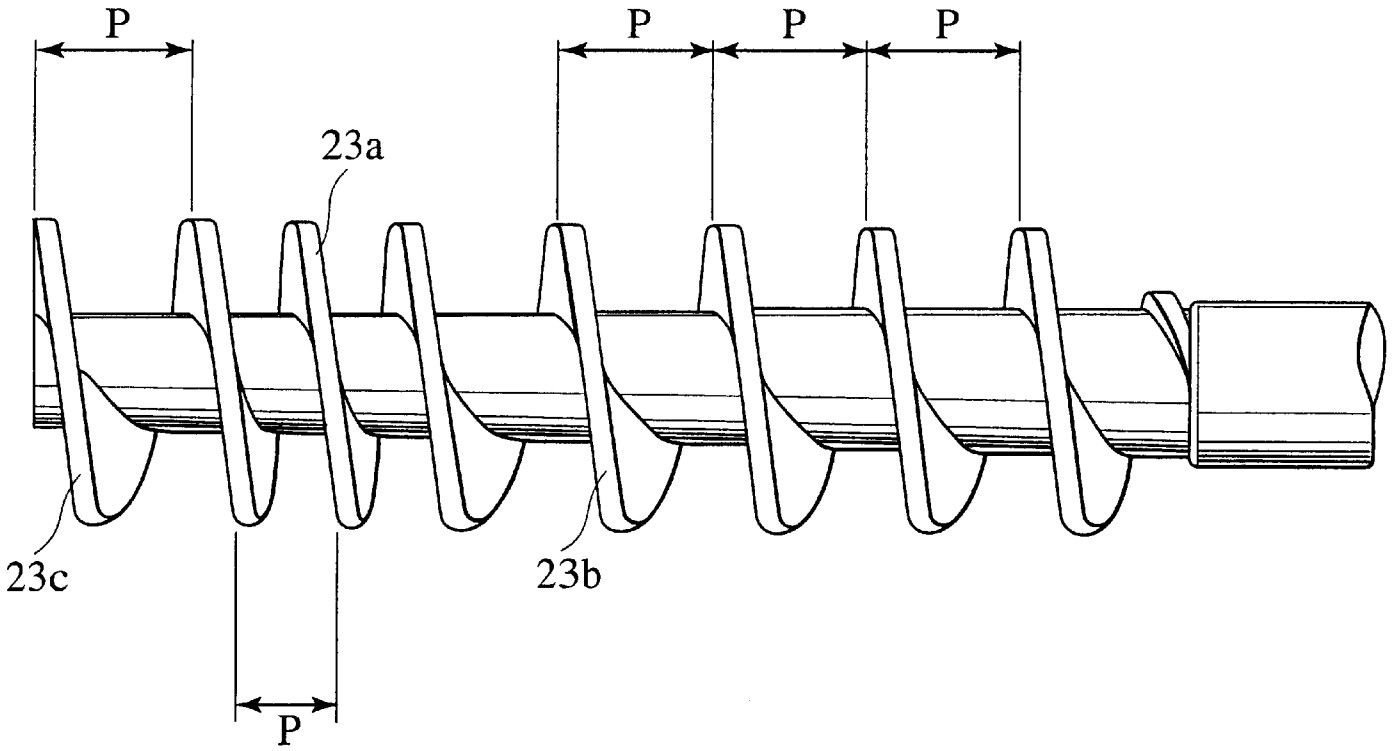
FIG. 8 is a front elevational view of a modified embodiment of a feed screw conveyor according to the present invention.

The feed blade 23 of the feed screw conveyor 19 has substantially no length around a base portion of the feed screw conveyor 19 and has a length gradually longer toward the side of the discharge port 13 of the hopper 9, as shown in FIG. 7. Accordingly, even if the waste received by the hopper 9 is fine and much, it becomes hard that the waste is caught on the feed blade 23. The feed screw shaft 21 is formed in a taper shape so as to be gradually narrower toward the side of the discharge port 13 of the hopper 9 from the side of the base end. Accordingly, when the lump of the waste is fed to the feed screw conveyor 19, a twist of the waste with the feed screw shaft 21 is gradually loosened, and the waste is easily removed. A pitch of the feed blade 23 in the feed screw conveyor 19 has a uniform interval from the side of the base end toward the side of the discharge port 13 of the hopper 9, however, as shown in FIG. 8, becomes gradually narrower toward the side of the discharge port 13 of the hopper 9, and further can be inversely made wider near the discharge port 13. According to the structure mentioned above, it is possible to make the feed speed of the waste slower in the side of the discharge port 13 than the side of the base end and make it faster near the discharge port 13. According to the structure mentioned above, it is hard that the lump of the waste clogs near the discharge port 13 and it is possible to continuously operate the waste compressed solid producing apparatus 1.

The switching means 111 for alternately switching the rotational direction of the feed motor 25 comprises a feed motor control unit 113, a first timer 115, a second timer 117 and a third timer 119 which are connected to the feed motor control unit 113, and is electrically connected to the feed motor 25. The first timer 115 controls a time for rotating the feed screw conveyor 19 in a feed direction (a feeding rotation time), and the second timer 117 controls a time for rotating in an opposite direction thereto (an opposite feeding rotation time). By alternately switching the rotational direction of the feed motor 25 by using these timers, the lump of the waste going to coil around the screw shaft 21 is removed, and it is possible to continuously operate the waste compressed solid producing apparatus 1. The third timer 119 controls a total rotational time of the feed screw conveyor 19 so as to adjust the waste fed to the compression chamber 47 to a proper amount.

A draw groove 27 passing through the discharge port 13 Ls formed in a bottom portion of the hopper 9, and a draw screw conveyor 29 drawing the waste in the hopper 9 is provided in the hopper 9. The draw screw conveyor 29 is provided with a draw screw shaft 31 capable of rotating in forward and backward directions in the draw groove 27, a forward wound draw blade 33 integrally formed in a spiral manner so as to coil around an upper side in FIG. 2 of the draw screw shaft 31 in a forward direction, a backward wound draw blade 35 integrally formed in a spiral manner so as to coil around a lower side in FIG. 2 of the draw screw shaft 31 in a backward direction, a draw motor 37 provided at a suitable position of a rear portion of the box-like frame 7 and connected to the draw screw shaft 31 in an interlocking manner, and a draw motor control unit 123. The draw blades 33 and 35 in the draw screw conveyor 29 are significantly larger than the feed blade 23 in the feed screw conveyor 19.

Figure 1:
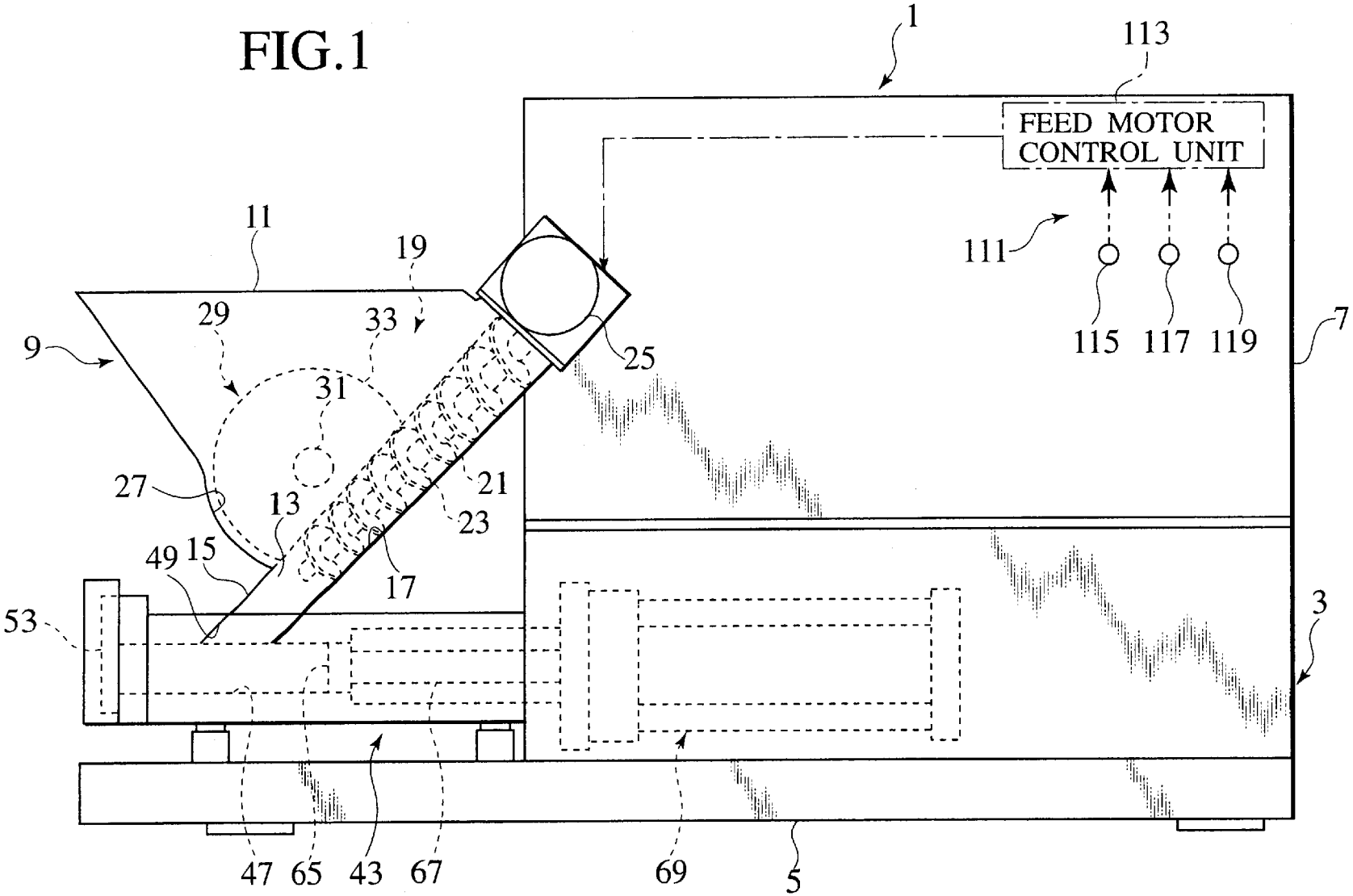
FIG. 1 is a front elevational view showing an apparatus for producing a waste compressed solid according to a first embodiment of the present invention.

As shown in FIG. 1, a compression box 43 is provided in a left side portion in FIG. 1 of the supporting frame 5, and this compression box 43 is provided with a compression chamber 47 having a circular cross sectional shape. A supply port 49 with which another end of the connection pipe 15 is communicated is formed in an upper portion in FIG. 1 of the compression box 43. An opening portion 51 is provided in a left side in FIG. 1 of the compression box 43 and a left edge in FIG. 1 of the supply port 49 has a sharp edge.

A circular piston 65 for compressing and solidifying the waste is provided with the compression chamber 41, and the piston 65 can move in a lateral direction in FIG. 1. In order to move the piston 65 In a lateral direction, a compression cylinder 69 provided with a movable rod 67 capable of moving in a lateral direction is provided in the supporting frame 5, and the piston 65 is connected to a front end portion of the movable rod 67 so as to be detachable. The piston 65 has an operation of cutting the waste in cooperation with the sharp edge of the supply port 49 in addition to an operation of compressing the waste.

Next, a description will be given of a method of producing the waste compressed solid by the apparatus mentioned above.

At first, the waste such as the metal chip or the like is received by the hopper 9 from the opening 11.

The feed motor 25 is connected to the feed screw conveyor 19, and drives the screw shaft 21 so as to integrally rotate the feed blade 23. The waste is carried to the discharge port 13 according to a motion of the feed blade 23, and is fed to the compression chamber 47 through the supply port 49 in the compression box 39.

A time for rotating the feed screw conveyor 19 in a feed direction is set by the first timer 115. When the time set by the first timer 115 has passed, the feed screw conveyor 19 is backward rotated so as to rotate in an opposite feed direction. Accordingly, even in the case that the lump of the waste coils around the screw shaft 21 in a process that the feed screw conveyor L9 rotates in the feed direction, the feed screw conveyor 19 rotates in the opposite feed direction, whereby there is generated an effect that the lump of the waste is dissembled. A time for which the feed screw conveyor 19 rotates in the opposite feed direction is set by the second timer 117.

The feed screw conveyor alternately rotates in the feed direction and the opposite feed direction on the basis of the set of the first timer 115 and the second timer 117, and this operation is repeated. Accordingly, it is possible to prevent the operation that the lump of the waste is dissembled from being prevented by the new waste being drawn, whereby a continuous operation can be performed. A time for which the operation is repeated is controlled by the third timer 119 setting the total rotational time. The set time of the first timer 115, the second timer 117 and the third timer 119 are previously set in an optimum manner in correspondence to a characteristic of the waste.

The draw motor 37 drives the draw screw shaft 31 when the feed screw conveyor 19 rotates in the feed direction, whereby the forward wound draw blade 33 and the backward wound draw blade 35 of the draw screw conveyor 29 integrally rotate therewith so as to draw the waste from both sides to the side of the feed screw conveyor 19. Accordingly, the waste in the hopper 11 is effectively fed to the feed screw conveyor 19.

The rotational direction of the draw screw conveyor 29 is controlled by the draw motor control unit 123 in correspondence to the rotational direction of the feed screw conveyor 19. When the feed screw conveyor 19 rotates in the feed direction, the draw screw conveyor 29 rotates in a direction of drawing the waste to a center side (a draw direction) and when the feed screw conveyor 19 rotates in an opposite feed direction, the draw screw conveyor 29 stops. It is possible to control so that when the feed screw conveyor 19 rotates in the opposite feed direction, the draw screw conveyor 29 rotates in an opposite direction (an opposite draw direction) to the direction of drawing the waste to the center side. Due to the operation of the draw screw conveyor 29 in cooperation with the feed screw conveyor 19 as mentioned above, it is possible to prevent the waste from clogging near the discharge port 13.

When the total rotational time set in the third timer 119 expires, the feed motor 25 is controlled by the feed motor control unit 113, and the rotation of the feed screw conveyor 19 is stopped. At the same time, the draw motor 37 is controlled by the draw motor control unit 123 and the rotation of the draw screw conveyor 29 is stopped. Further, the compression cylinder 69 operates, so that the piston 65 moves in a left direction in FIG. 1. The waste running over upward from the supply port 49 is cut on the basis of a cooperation between a left edge portion of the piston 65 and the blade portion at a time when the left edge portion of the piston 65 passes through the sharp edge of the supply port 49. By further moving the piston 65 in the left direction in FIG. 1 sequentially, the waste in the compression chamber 47 is compressed and solidified.

After the compression of the waste is finished, a take-out port 53 of the compression chamber 47 is opened. Further, by moving the piston 65 in the left direction in FIG. 1 due to the operation of the compression cylinder 69, the waste is extruded in the left direction. Accordingly, it is possible to take out the waste compressed solid.

The process mentioned above is continuously executed in a repeated manner. Accordingly, it is possible to continuously produce the waste compressed solid from the waste.

Figure 4:
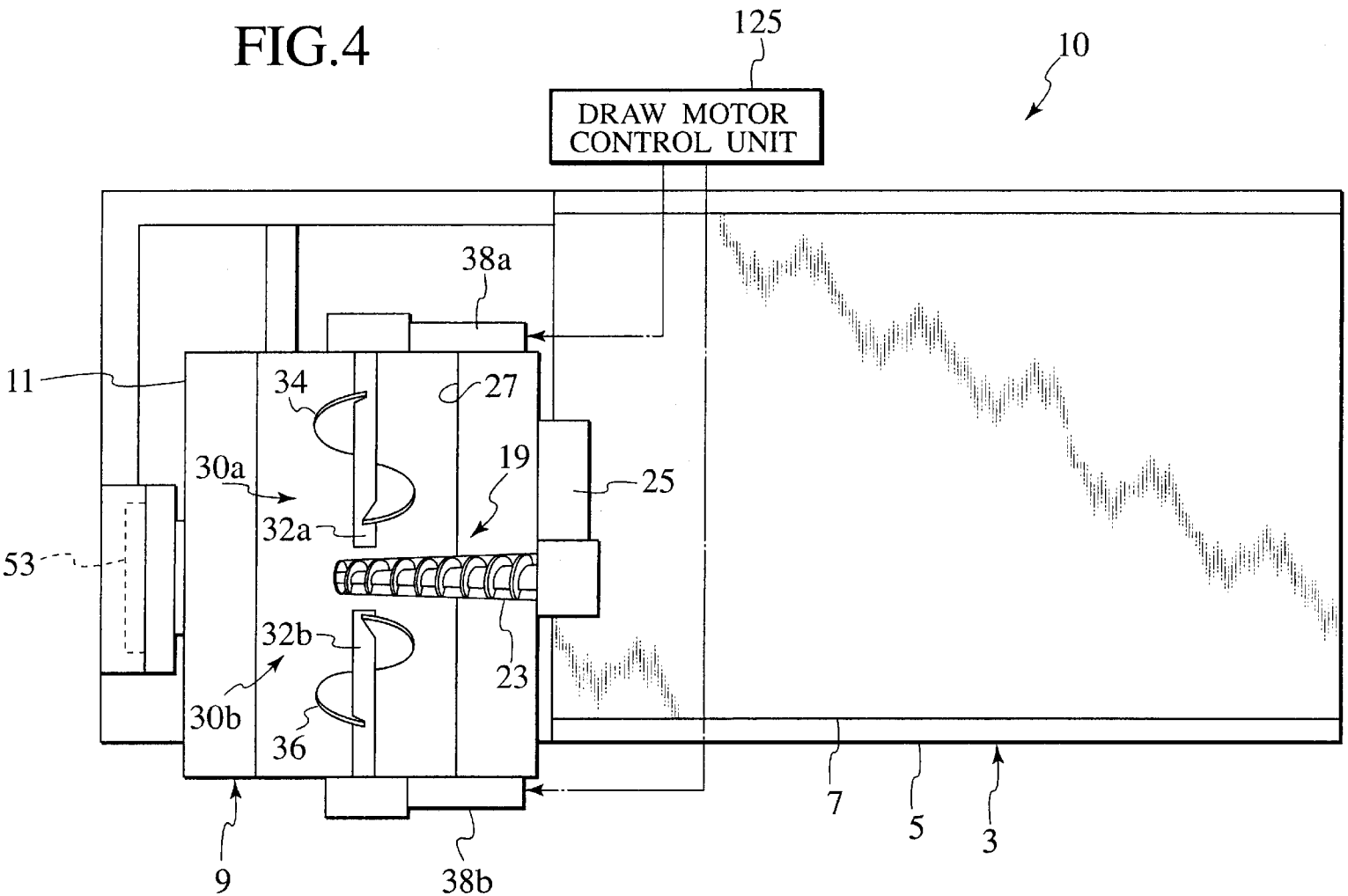
FIG. 4 is a plan view showing an apparatus for producing a waste compressed solid according to a second embodiment of the present invention.
Figure 5:
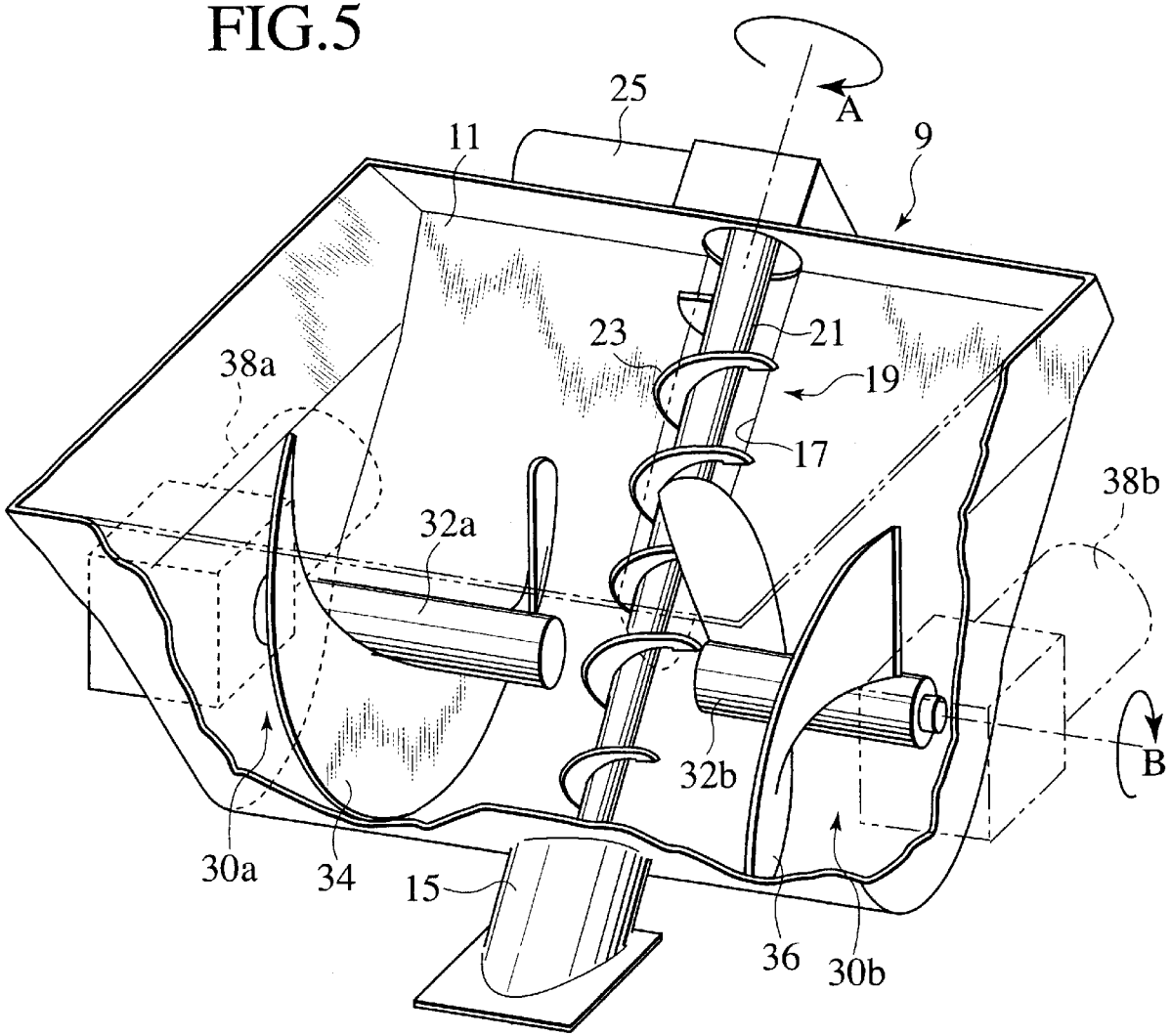
FIG. 5 is a perspective view showing an inner portion of a hopper in the apparatus for producing the waste compressed solid according to the second embodiment of the present invention.
Figure 6:
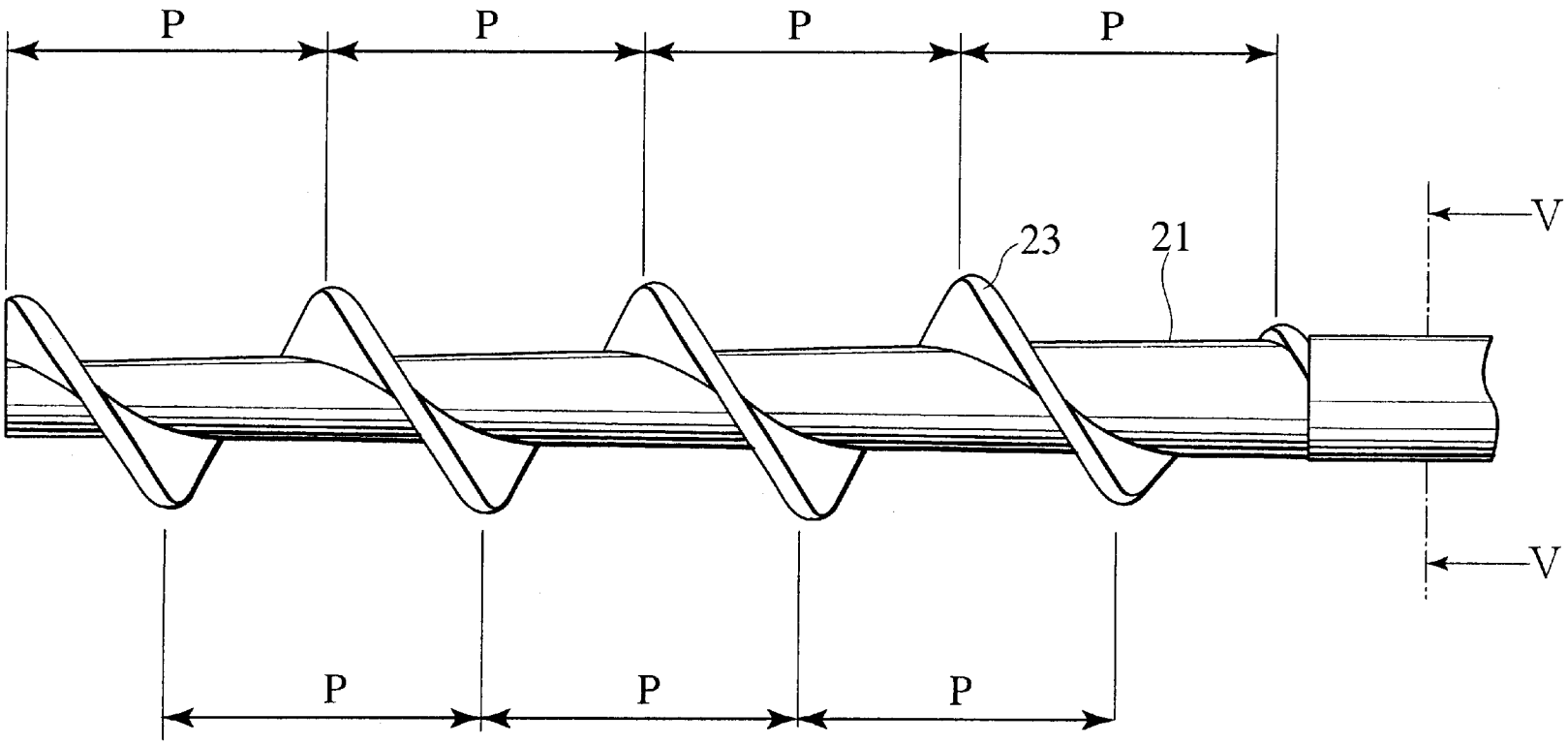
FIG. 6 is a front elevational view of a feed screw conveyor according to the present invention.

Next, a description will be given of a second embodiment according to the present invention with reference to FIGS. 4 and 5. In these drawings, the same reference numerals are attached to the same elements as those in FIGS. 1 to 3. A description will be given only of portions, which are different from the first embodiment, and a description of the portion having the coinciding structures will be omitted.

A waste compressed solid producing apparatus 10 according to the present embodiment is provided with a first draw screw conveyor 30*a* having a spiral-shaped draw blade and a second draw screw conveyor 30*b* in such a manner as to be substantially vertical to the feed screw conveyor 19 and be in symmetrical with each other. Further, there are provided a first draw motor 38*a* and a second draw motor 38*b* which respectively drive them, and a draw motor control unit 125 controlling rotations thereof.

The draw motor control unit 125 is electrically connected to the first and second draw motors 38*a* and 38*b* so as to control a rotational direction and a rotational speed of the first and second draw screw conveyor 30*a* and 30*b*. When the feed screw conveyor 19 rotates in the feed direction, the draw motors 38*a* and 38*b* are rotated in a direction in which the draw screw conveyors 30*a* and 30*b* draw the waste to the center side (a draw direction). Accordingly, the waste in the hopper 11 can be efficiently fed to the feed screw conveyor 19, and since the respective draw screw shafts 32*a* and 32*b* do not exist immediately above the feed screw shaft 21, it is possible to prevent the lump of the waste coiling around the feed screw shaft 21 from being caught on the respective draw screw shafts 32*a* and 32*b*.

In this case, the first draw motor 38*a* and the second draw motor 38*b* are controlled by the draw motor control unit 125 so that the rotational speed of the first draw screw conveyor 30*a* is different from the rotational speed of the second draw screw conveyor 30*b*. Since the rotational speeds of the draw screw conveyors 30*a* and 30*b* are different, a compelling force in a twisting direction is applied to the drawn waste, so that it is possible to prevent the waste from floating up. Accordingly, it is possible to efficiently draw the waste to the feed screw conveyor 19.

When the feed screw conveyor 19 rotates in the opposite feed direction, the draw motors 38*a* and 38*b* are controlled so as to stop the draw motors 38*a* and 38*b* or rotate the screw conveyors 30*a* and 30*b* in the opposite draw direction. Due to the operation of the draw screw conveyors 30*a* and 30*b* in cooperation with the feed screw conveyor 19 as mentioned above, it is possible to prevent the waste from clogging near the discharge port 13.

According to the second embodiment of the present invention, in addition to the effects of the first embodiment mentioned above, it is possible to prevent the lump of the waste coiling around the feed screw shaft 21 from being caught on the first and second draw screw conveyors 68*a* and 68*b*. Further, since the rotational speeds of the first and second draw screw conveyors 68*a* and 68*b* are different, it is possible to prevent the waste from floating up and it is possible to more efficiently draw the waste to the feed screw conveyor 20. Accordingly, it is possible to continuously operate the apparatus without interrupting the production of the compressed solid, and an efficiency of the producing operation can be improved.

What is claimed is:

1. An apparatus for producing a waste compressed solid comprising:

a hopper comprising an opening for receiving a waste in an upper side thereof and a discharge port in a bottom side;

a feed screw conveyor for feeding said waste in said hopper to said discharge port;

a first draw screw conveyor and a second draw screw conveyor, each comprising a spiral-shaped draw blade drawing said waste in said hopper to a neighbor of said feed screw conveyor;

a compression chamber comprising a supply port communicated with said discharge port of said hopper and a take-out port for said waste; and a movable piston compressing said waste in said compression chamber, wherein shafts of said first and second draw screw conveyors substantially vertically cross to a shaft of said feed screw conveyor in a close manner, and spiral-shaped draw blades of said first and second draw screw conveyors are symmetrical to the shaft of said feed screw conveyor.

2. An apparatus for producing a waste compressed solid according to claim 1, wherein the feed screw conveyor has gradually changing pitches and the pitches at a proximal end and a distal end thereof are wider than the pitches at a center thereof.

3. An apparatus for producing a waste compressed solid according to claim 1, further comprising a feed motor control unit comprising a first timer and a second timer, said timers controlling a rotation of a feed motor for driving said feed screw conveyor, wherein a time for driving in a feed direction is controlled by said first timer and a time for driving in an opposite direction is controlled by said second timer.

4. An apparatus for producing a waste compressed solid according to claim 1, further comprising first and second draw motor control units respectively controlling rotational directions of first and second draw motors for respectively driving said first and second draw screw conveyors, wherein said first and second draw motor control units control rotations of said first and second draw motors on the basis of different speeds in respective directions in which said first and second draw screw conveyors draw the waste to the neighbor of said screw conveyor when said feed screw conveyor rotates in a direction of feeding said waste to said discharge port.

5. An apparatus for producing a waste compressed solid according to claim 1, wherein the shaft of the feed screw conveyor is formed in a taper shape gradually narrowing toward a side of said discharge port of said hopper.

6. An apparatus for producing a waste compressed solid comprising:

a hopper comprising an opening for receiving a waste in an upper side thereof and a discharge port in a bottom side thereof;

a feed screw conveyor for feeding the waste in the hopper to the discharge port;

a draw screw conveyor for drawing the waste in the hopper to a neighbor of the feed screw conveyor from both sides thereof, the draw screw conveyor having a shaft crossing close to a shaft of the feed screw conveyor and being alternately rotatable in both directions;

a compression chamber comprising a supply port communicated with the discharge port of the hopper and a take-out port for the waste;

a movable piston compressing the waste in the compression chamber; and a draw motor control unit controlling a rotation of the draw screw conveyor in correspondence to the feed screw conveyor, the rotation being controlled in a drawing direction when the feed screw conveyor rotates in a feeding direction and the rotation being controlled opposite to the drawing direction or to be stopped when the feed screw conveyor rotates opposite to the feeding direction;

wherein:

the draw screw conveyor is a pair of screw conveyors symmetrical to each other relative to an axis of the feed screw conveyor and rotations of the pair of screw conveyors are independently controlled by the draw motor control unit.

7. An apparatus for producing a waste compressed solid according to claim 6, wherein the shaft of the feed screw conveyor is formed in a taper shape gradually narrowing toward a side of said discharge port of said hopper.

* * * * *